United States Patent [19]

Bea et al.

[11] 4,169,040

[45] Sep. 25, 1979

[54] STAGED PROCESS FOR THE PRODUCTION OF MIDDLE DISTILLATE FROM A HEAVY DISTILLATE

[75] Inventors: Donald A. Bea, Lafayette; Joseph Jaffe, Berkeley, both of Calif.

[73] Assignee: Chevron Research Company, San Francisco, Calif.

[21] Appl. No.: 900,379

[22] Filed: Apr. 26, 1978

[51] Int. Cl.[2] ..... C10G 13/02; C10G 37/02; B01J 21/12; B01J 35/00

[52] U.S. Cl. ..... 208/59; 208/254 H; 252/455 R; 252/477 R

[58] Field of Search ..... 208/59; 252/455 S, 477 R

[56] References Cited

U.S. PATENT DOCUMENTS

| | | | |
|---|---|---|---|
| 3,172,838 | 3/1965 | Mason et al. | 208/61 |
| 3,174,925 | 3/1965 | Claussen et al. | 208/59 |
| 3,184,402 | 5/1965 | Kozlowski et al. | 208/59 |
| 3,268,436 | 8/1966 | Arey et al. | 208/59 |
| 3,268,437 | 8/1966 | Beuther et al. | 208/61 |
| 3,513,086 | 5/1970 | Kay | 208/59 X |

*Primary Examiner*—Delbert E. Gantz
*Assistant Examiner*—G. E. Schmitkons
*Attorney, Agent, or Firm*—D. A. Newell; R. H. Davies; M. K. Bosworth

[57] ABSTRACT

Middle distillate oil is produced with a minimum production of lighter hydrocarbons by (1) contacting hydrogen gas and a heavy distillate oil containing nitrogenous hydrocarbons with a catalyst in a first reaction zone under selected conditions, and (2) contacting hydrogen gas and at least a portion of the resulting effluent from the first zone with a catalyst in a second reaction zone under selected conditions. In each zone the catalyst is a composite of an amorphous silica-alumina carrier and a hydrogenation component wherein the silica and hydrogenation component are highly dispersed.

14 Claims, 1 Drawing Figure

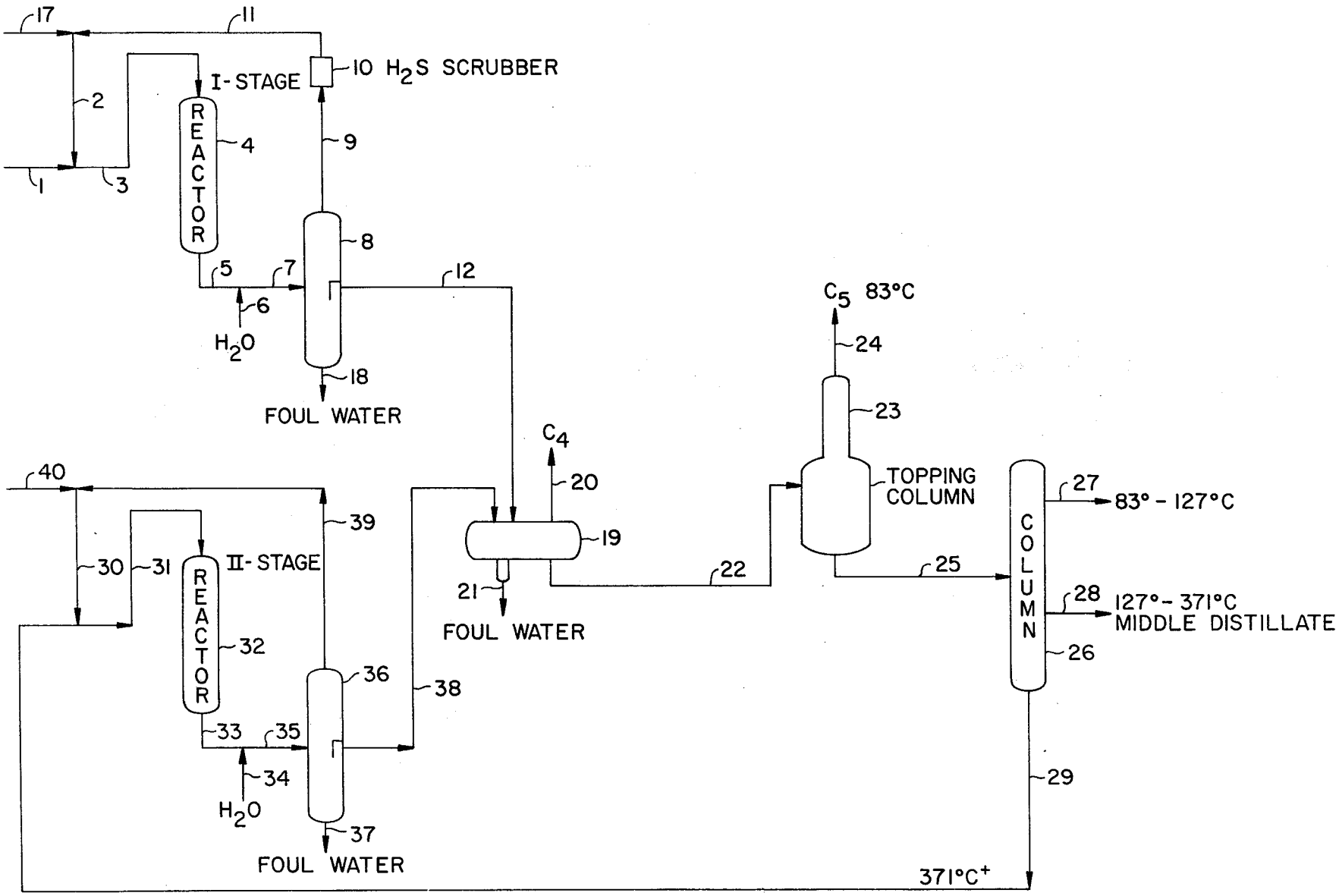
I-STAGE
REACTOR
10 $H_2S$ SCRUBBER
FOUL WATER
$H_2O$
II-STAGE
REACTOR
FOUL WATER
$H_2O$
FOUL WATER
$C_4$
$C_5$ 83°C
TOPPING COLUMN
COLUMN
83° - 127°C
127°- 371°C MIDDLE DISTILLATE
371°C+

STAGED PROCESS FOR THE PRODUCTION OF MIDDLE DISTILLATE FROM A HEAVY DISTILLATE

BACKGROUND OF THE INVENTION

This invention relates to a process for producing middle distillate from heavy distillate oil. More particularly, it relates to a staged process wherein a heavy distillate oil containing nitrogenous hydrocarbon impurities is effectively converted to middle distillate using selected catalyst and conditions.

A strong continuing need and demand for middle distillate oil is being felt in the industry. Heavy distillate oil has been and remains a desirable source of middle distillate oil. However, heavy oils are, in large part, diverted to fuel oils because of the lack of an effective method for converting them to lower-boiling products. These oils usually contain significant amounts of nitrogenous hydrocarbon impurities. Thus, in addition to hydrocracking, their conversion involves nitrogen removal, and therein lies a problem. Catalysts normally selective for converting middle distillates to gasoline, for example composites of amorphous silica-alumina cracking base and a hydrogenating component, produce large amounts of dry gases, butanes and gasoline when used with heavy distillate feedstocks (see, for example, U.S. Pat. No. 3,513,086). Conditions satisfactory for selective nitrogen removal by most conventional catalysts are usually unsatisfactory for selective hydrocracking.

It is known to convert a heavy distillate oil to a middle oil using a sulfided nickel-tungsten catalyst composited with a siliceous cracking base having a cracking activity above 45, for example as in U.S. Pat. No. 3,268,437. However, the product appears to only be suitable for use as a cutter oil for residual fuels.

It is also known to convert petroleum distillate to gasoline, middle distillates and isobutane in a two-stage process using (1) in the first stage a weakly acidic hydrocracking catalyst, for example a catalyst containing a Group VI and VIII hydrogenating component on a silica-magnesia support (also see U.S. Pat. No. 3,172,838 and U.S. Pat. No. 3,180,817) and (2) in the second stage an active acidic hydrocracking catalyst. However, (1) silica-magnesia based catalysts usually exhibit excessive fouling rates and (2) the use of an active acidic hydrocracking catalyst in the second stage may promote overcracking of feedstock, thereby favoring gasoline and light hydrocarbon production over desired middle distillate production.

It is further known, for example in U.S. Pat. No. 3,184,402, to maximize middle distillate production from a hydrocarbon distillate in a two-stage process using (1) in the first stage a weakly acidic hydrocracking catalyst, for example Ni-Mo on alumina (also see U.S. Pat. No. 3,513,086), and (2) in the second stage a catalyst comprising a hydrogenating-dehydrogenating component on an active cracking component. However, in addition to requiring use of different catalysts for each stage, yields of middle distillate, based upon feed to the first stage, are only nominal, that is, of the order of 38 to 46 liquid volume percent.

It is an object of this invention to provide an effective and improved process for producing middle distillate from a heavy distillate oil containing nitrogenous hydrocarbon impurities.

Other objects will be clear from the description and examples herein.

SUMMARY OF THE INVENTION

A process is provided for producing middle distillate from a heavy distillate feed having a boiling point range in the normal boiling point range above 343° C. and a nitrogenous hydrocarbon content, calculated as nitrogen, of at least 100 ppmw, the steps comprising:

(1) contacting in a first reaction zone said feed and hydrogen gas with a catalyst under conditions including:

(a) a temperature below about 454° C. (850° F.);

(b) a hydrogen partial pressure above about 69 atmospheres (1000 psig);

(c) a hydrogen gas-to-feed ratio in the range of from about 0.356 to 3.56 SCM/L (2,000–20,000 SCF/BBL); and (d) a liquid hourly space velocity in the range of from about 0.1 to 5 V/V/Hr.;

said conditions being selected to produce a first reaction zone effluent containing a first liquid hydrocarbon phase having (i) a nitrogenous hydrocarbon content, calculated as nitrogen, above about 1 ppmw, preferably 5 ppmw, and less than one-half of that of said feed, and (ii) a content of product resulting from said contacting boiling in the range below about 371° C. (700° F.) of less than about 50 volume percent of said feed;

(2) passing said first reaction zone effluent and admixed water into a first high-pressure separation zone;

(3) withdrawing from said first separation zone a first intermediate liquid hydrocarbon phase, a first liquid foul-water phase, and a first gas comprising hydrogen;

(4) contacting a bottoms feed and hydrogen gas with a catalyst in a second reaction zone under conditions including:

(a) a temperature below about 454° C. (850° F.);

(b) a hydrogen partial pressure above about 69 atmospheres (1000 psig);

(c) a hydrogen gas-to-feed ratio in the range of from about 0.356 to 3.56 SCM/L (2,000–20,000 SCF/BBL); and (d) a liquid hourly space velocity in the range of from about 1 to 20 V/V/Hr.; said conditions being selected to produce a second reaction zone effluent containing, based upon said bottoms feed, an amount of hydrocarbons boiling below about 371° C. (700° F.) in the range of from about 40 to 70 volume percent;

(5) optionally passing said second reaction zone effluent and admixed water into a second high-pressure separation zone;

(6) withdrawing from said second separation zone a second intermediate liquid hydrocarbon phase, a second liquid foul-water phase, and a second gas comprising hydrogen;

(7) passing said first and second intermediate liquid hydrocarbon phases into a low-pressure separation zone;

(8) withdrawing from said low-pressure separation zone a second liquid hydrocarbon phase, a third liquid foul-water phase, and a gas comprising light hydrocarbons;

(9) separating said second hydrocarbon phase into at least two fractions, including:

(a) an overhead middle distillate fraction boiling in the range of from about 127° C. (260° F.) to 371° C. (700° F.); and (b) a bottoms fraction boiling in the range above about 371° C. (700° F.), said bottoms fraction, at least in part, being used as said bottoms feed;

and wherein said catalysts for said zones are selected from the group consisting of catalysts comprising an amorphous silica-alumina carrier component containing for each part by weight of silica an amount of alumina in the range of from about 0.6 to 4 parts, and at least one hydrogenation component selected from the group consisting of the metals, oxides and sulfides of nickel, cobalt, molybdenum and tungsten, said catalyst containing for each 100 parts by weight an amount, calculated as metal, of said hydrogenation component in the range of from about 1 to 50 parts, said silica and preferably said hydrogenation components, in terms of electron microprobe composition scan of said catalyst, having standard deviations in their respective concentrations around the mean thereof, which is less than about 25 percent.

In a preferred aspect of the above-described invention, the liquid hydrocarbon phase resulting in said low-pressure separator is fractionated, for example, into at least two fractions, including an overhead middle distillate fraction boiling in the range of from about 127° C. (260° F.) to 371° C. (700° F.) and a bottoms fraction boiling in the range above about 371° C. (700° F.).

Surprisingly, the above-described stabilized, highly silica-dispersed hydrocarbon hydrodenitrification catalyst has been found to be especially satisfactory for use in both stages of a two-stage hydrocarbon conversion process for effective middle distillate production, provided that (1) the second stage sees a relatively clean feed, (2) excessive cracking is avoided, especially in the first stage, and (3) the process is carried out in a plant sized to accommodate a fresh feed rate of at least about 1590 KL (10,000 barrels) per day. These requirements are met by carrying out the process under conditions within the ranges prescribed above and result in high middle distillate yields.

Embodiment

In a preferred embodiment, illustrated by the accompanying FIGURE which is a schematic process flow diagram, middle distillate is produced in high yield using a 371°–565° C. (700°–1050° F.) normal boiling range Arabian medium straight-run gas oil feed.

Referring now to the FIGURE, the first- and second-stage fixed-bed reactors 4 and 32, respectively, are charged with a stabilized hydrodenitrification catalyst having about the following composition:

| Component | Wt. % |
|---|---|
| NiO | 10 |
| $WO_3$ | 25 |
| $SiO_2$ | 27 |
| $Al_2O_3$ | 30 |
| $TiO_2$ | 8 |

This catalyst is uniquely suitable because (1) the silica content of the carrier component is highly dispersed, as contrasted with localized regions rich in silica, as shown by a scanning electron microprobe, and (2) its hydrocarbon hydrodenitrification activity is stabilized against excessive decline, especially through repeated use and regeneration cycles, by the presence of a titania component in the composite.

The inspections for a representative feed to the first stage reactor are as follows:

| | |
|---|---|
| API Gravity | 21.5 |
| Sulfur, Wt. % | 2.8 |
| Nitrogen, ppmw | 700 |
| C/H Ratio, Wt. | 7.2 |
| D 1160, °F. | |
| ST/10 | 550/743 |
| 30/50 | 815/880 |
| 70/90 | 952/1035 |
| 95/EP | 1065/1100 |

Reference is now made to the FIGURE, which is a flow sheet illustrating the invention in one of its preferred aspects. In the description below, it will be understood that the drawing has been simplified by the omission of certain conventional elements such as valves, pumps, compressors, heaters, coolers, and the like. It will be understood that heat conserving means will be combined, for example, into banks of heat exchangers and fired heaters, according to standard engineering practice. The fractionating equipment shown is merely illustrative of a system providing for maximum flexibility in handling different feedstocks. Different feedstocks may require standard modifications for maximum economy.

In the process, feed from line 1 and hydrogen gas from line 2 are mixed in line 3 and passed to first stage reactor 4 via line 3 which includes (not shown) an ordinary heating furnace. The process conditions maintained in reactor 4 include (1) a hydrogen partial pressure of 96.2 atmospheres (1400 psig), (2) a hydrogen-to-feed ratio of about 0.712 SCM/KL (4000 SCF/BBL), (3) a liquid hourly space velocity of about 1.25 and a temperature in the range 343° C. (650° F.) to 454° C. (850° F.) and sufficient to produce a reaction zone effluent of which the liquid hydrocarbon phase has a nitrogenous hydrocarbon content, calculated as nitrogen, of about 5 ppmw. In order to achieve and maintain this nitrogen level, the feed mixture is introduced at start-up of the process at about 371° C. (700° F.) and thereafter is adjusted as required to provide the desired product. Thereafter, as the catalyst ages and becomes fouled by deposited carbon and the like, the temperature of the feed is adjusted upward until the cut-off temperature, for example 454° C. (850° F.) is reached. At this time, the catalyst is regenerated by burning off the accumulated carbon using molecular oxygen in the conventional manner. After regeneration, the process is continued as described above.

Via line 5 the resulting product stream is withdrawn from reactor 4 and, together with water added via line 6, is introduced via line 7 into high-pressure separator 8. The temperature and pressure in separator 8, except for minor cooling from the water addition and heat loss in the transfer line, is substantially that in reactor 4. In separator 8, this stream is divided into (1) a vapor phase which is mainly hydrogen gas and hydrogen sulfide plus minor amounts of water vapor, ammonia and light hydrocarbons, (2) a liquid hydrocarbon phase, and (3) a foul-water phase containing ammonium sulfide. Via line 9 the vapor phase is withdrawn from separator 8 and passed to hydrogen sulfide scrubber 10. Scrubbed hydrogen gas from scrubber 10 is passed in recycle to the process via lines 11 and 2, together with makeup hydrogen gas added via line 17. A bleed line, not shown, may be included to prevent buildup of undesirable light hydrocarbon diluents, methane, for example, in the hydrogen stream. Alternatively, at least a portion of the recycle hydrogen gas stream may be scrubbed suitably free of light hydrocarbons by conventional means (not shown) by using a heavy hydrocarbon as the scrubbing fluid.

Via line 18, the foul-water phase is withdrawn from separator 8 for suitable processing and disposal, for example, in a waste-water treating plant.

Via line 12 the liquid hydrocarbon phase is withdrawn from separator 8 and passed to low-pressure separator 19, the temperature and pressure therein being appropriate to produce in separator 19 (1) a vapor phase comprising $C_4$- hydrocarbons, (2) a foul-water phase and (3) a liquid hydrocarbon phase, that is a temperature of about 60° C. (140° F.) and a pressure of about 17 atmospheres (250 psig).

The $C_4$- vapor phase and the foul-water phase are withdrawn from separator 19 via lines 20 and 21, respectively. The liquid hydrocarbon phase is withdrawn via line 22 and passed to topping column 23 wherein it is separated into (1) a fraction boiling up to about 83° C. (180° F.) which is withdrawn via line 24 for recovery by conventional means as desired and (2) a bottoms fraction. The bottoms fraction from column 23 is passed via line 25, which includes a heating furnace (not shown), to fractionating column 26 for separation into (1) a 83°-127° C. (180°-260° F.) isocrackate (recovered via line 27), (2) a 127°-371° C. (260°-700° F.) middle distillate (recovered via line 28) and (3) a 371° C. (700° F.) plus bottoms fraction. Alternatively, the middle distillate may be separated into 127°-260° C. and 260°-371° C. cuts.

Via line 29 the bottoms fraction from column 26 is withdrawn from column 26 and passed via line 31, which includes a heating furnace (not shown), together with hydrogen gas from line 30 to second stage reactor 32.

The process conditions maintained in reactor 32 include (1) a hydrogen partial pressure of about 96 atmospheres (1400 psig), (2) a hydrogen-to-feed ratio of about 114 SCM/KL (4000 SCF/BBL), (3) a liquid hourly space velocity of about 1.33 and a temperature in the range 343°-454° C. (650°-850° F.) and sufficient to provide about a 60 volume percent per pass conversion of the feed to product boiling below 371° C. (700° F.). In order to achieve and maintain the conversion level, the feed mixture at start-up of the process is introduced into reactor 32 at about 371° C. (700° F.) and thereafter the temperature is adjusted to provide the 60 volume percent conversion. Thereafter, as the catalyst ages and becomes fouled by deposited carbon and the like, the temperature of the feed is adjusted upward until the cut-off temperature, for example 454° C. (850° F.), is reached. After startup and lining-out of the two reactors, the fouling rates for the catalysts in each stage are determined. The process conditions in one or both of these reactors are then adjusted within the specified ranges such that each reactor reaches its end-of-run temperature at about the same time. Temperature adjustment is usually the most convenient control means.

The resulting product in reactor 32 is withdrawn via line 33 and together with water introduced via line 34 is introduced via line 35 to high-pressure separator 36 which is maintained in the same manner as separator 8. The foul-water phase is withdrawn from the process via line 37 and the liquid hydrocarbon phase is passed via line 38 to low-pressure separator 19. The gaseous phase, which comprises hydrogen gas and may contain a minor amount of hydrogen sulfide is withdrawn from separator 36 via line 39 and recycled together with makeup hydrogen from line 40 to process via line 30. Optionally, if desirable, for example in order to avoid excessive hydrogen sulfide buildup in the hydrogen gas in the second-stage process loop, a bleed stream is taken from line 39 via a line, not shown, and delivered to scrubber 10. Typical liquid volume percent yields resulting from the foregoing example are listed in the Table below:

| Product | Yield, LV% |
|---|---|
| $C_5$-83° C. ($C_5$-180° F.) | 10 |
| 83°-149° C. (180°-300° F.) | 16 |
| 149°-371° C. (300°-700° F.) | 85 |
| $C_5$-371° C. ($C_5$-700° F.) | 111 |

The hydrogen consumption is in the range of from about 0.23 to 0.25 SCM/L (1300 to 1400 standard cubic feet per barrel) of fresh feed.

Catalysts satisfactory for use in the process of the invention contain an amorphous silica-alumina component wherein there is present for each part by weight of silica an amount of alumina in the range of from about 1 to 6 parts, preferably about 1.1 parts. In addition, the silica must be highly dispersed in the alumina, that is in contrast to a component where there are discernable regions rich in silica in an alumina matrix. Suitable silica-alumina components are obtained where the silica and alumina are concurrently coprecipitated from a common solution. A further requirement is that the catalyst be stabilized against the substantial loss of hydrodenitrification activity experienced by ordinary hydrodenitrification catalysts, for example in succeeding multiple cycles of use and carbon burnoff regenerations. To this end the catalyst desirably contains a titanium component, calculated as titanium dioxide, based upon the catalyst composite, in the range of from about 5-15, preferably about 8 weight percent.

Optionally, the catalyst may contain a minor amount of a phosphorus component, calculated as $P_2O_5$, and based upon the composite catalyst, in the range of from about 1 to 5 weight percent. This component reduces the fouling rate of the catalyst.

Hydrocarbon feedstocks which are advantageously processed herein are those heavy hydrocarbon distillates containing an excessive amount of nitrogenous hydrocarbon compounds, for example, calculated as nitrogen, above about 100 ppmw. Common practice has been to hydrodenitrify such feedstocks under conditions whereby the nitrogen content of the resulting liquid hydrocarbon product is essentially nil and at the same time achieving as much hydrocracking of the feed as reasonably possible, especially in a single-stage process, and even in a two-stage process, the idea being that such practice provides the most economical use of the catalyst and process hardware. Surprisingly, and especially as herein, where a middle distillate product is required, this has not been found to be the case for plants sized to process at least about 1590 KL (10,000 barrels of fresh feed) per day. For larger plants, the relative advantage of the process of the invention over a conventional process generally increases with increased size thereof.

By a heavy distillate as used herein is meant by definition a distillate oil boiling in the normal boiling point range above about 343° C. (650° F.).

Representative heavy distillates satisfactory for use as feedstocks for the process herein include straight run gas oils, vacuum gas oils, coker gas oils, deasphalted crude oils, cycle oils derived from cracking operations, and the like oils having a substantial content of nitrogenous compounds. These feedstocks may be derived from petroleum crude oils, tar sand oils, coal hydrogenation products and the like. Preferred feedstocks contain at least a major fraction having a normal boiling point range above 343° C. (650° F.), more preferably in the range of from about 371° C. (700° F.) to about 593° C. (1100° F.).

In order to achieve the primary objects of the present invention, that is (1) to maximize middle distillate yield and (2) minimize gasoline yield and to do so efficiently and effectively, the present process must be carried out in a two-stage plant sized to process heavy distillate feedstocks at a fresh feed rate of at least about 1590 KL (10,000 barrels) per day wherein process conditions in the first stage must be selected to provide limited severity and only sufficient to reduce the nitrogenous compound content of the treated feed to the range above about 1 ppmw, preferably 5 ppmw, and less than one-half of that of the feed, preferably in the range 5 to 30 ppmw, without excessive concurrent cracking. To this end satisfactory first stage conditions include (1) a temperature in the range below about 454° F. (850° C.), preferably 343°–454° C. (650° to 850° F.), more preferably 371°–426° C. (700° to 800° F.), (2) a hydrogen gas partial pressure in the range of from about 68–156 atmospheres (1000 to 2300 psig), preferably 112–136 atmospheres (1650 to 2000 psig), (3) a liquid hourly space velocity in the range of from about 0.1 to 5, preferably 1 to 2 V/V/Hr, and (4) a hydrogen gas-to-feed ratio in the range of from about 0.356 to 1.78 SCM/L (2000 to 10,000 SCF per barrel). Best results are achieved when the hydrogen gas feed to the first stage consists essentially of hydrogen. In general, the pre-pass conversion in a satisfactory first stage herein of feed to product boiling in the range below about 371° C. (700° F.) must be below about 70 volume percent and usually is in the range of from about 40 to 50 volume percent.

Conditions in a satisfactory second stage of the process must be selected to provide a per-pass conversion of feed to product boiling in the range below about 371° C. (700° F.) in the range of from abut 50 to 80 volume percent, preferably 55 to 65 volume percent. These include (1) a temperature below about 454° C. (850° F.), preferably 371°–426° C. (700° to 800° F.), (2) a hydrogen gas pressure in the range of from about 81.6 to 156.5 atmospheres (1200 to 2300 psig), preferably 91.8 to 102 atmospheres (1350 to 1500 psig), (3) a liquid hourly space velocity in the range of from about 0.5 to 15, preferably 1 to 10 V/V/Hr and (4) a hydrogen gas-to-feed ratio in the range of from about 0.53 to 1.78 SCM/L (3000 to 10,000), preferably 0.62 to 1.06 SCM/L (3500 to 6000 SCF per barrel).

What is claimed is:

1. A process for producing middle distillate from a heavy distillate feed having a boiling point range in the normal boiling point range above 343° C. and a nitrogenous hydrocarbon content, calculated as nitrogen, of at least 100 ppmw, the steps comprising:

(1) contacting in a first reaction zone said feed and hydrogen gas with a catalyst under conditions including:
  (a) a temperature below about 454° C. (850° F.);
  (b) a hydrogen partial pressure above about 69 atmospheres (1000 psig);
  (c) a hydrogen gas-to-feed ratio in the range of from about 0.356 to 3.56 SCM/L (2,000–20,000 SCF/BBL); and
  (d) a liquid hourly space velocity in the range of from about 0.1 to 5 V/V/Hr.;

said conditions being selected to produce a first reaction zone effluent containing a first liquid hydrocarbon phase having (i) a nitrogenous hydrocarbon content, calculated as nitrogen, above about 1 ppmw and less than one-half of that of said feed, and (ii) a content of product resulting from said contacting boiling in the range below about 371° C. (700° F.) of less than about 50 volume percent of said feed;

(2) passing said first reaction zone effluent and admixed water into a first high-pressure separation zone;

(3) withdrawing from said first separation zone a first intermediate liquid hydrocarbon phase, a first liquid foul-water phase, and a first gas comprising hydrogen;

(4) contacting a bottoms feed and hydrogen gas with a catalyst in a second reaction zone under conditions, including:
  (a) a temperature below about 454° C. (850° F.);
  (b) a hydrogen partial pressure above about 69 atmospheres (1000 psig);
  (c) a hydrogen gas-to-feed ratio in the range of from about 0.356 to 3.56 SCM/L (2,000–20,000 SCF/BBL); and
  (d) a liquid hourly space velocity in the range of from about 1 to 20 V/V/Hr.;

said conditions being selected to produce a second reaction zone effluent containing, based upon said bottoms feed, an amount of hydrocarbons boiling below about 371° C. (700° F.) in the range of from about 40 to 70 volume percent;

(5) passing said second reaction zone effluent and admixed water into a second high-pressure separation zone;

(6) withdrawing from said second separation zone a second intermediate liquid hydrocarbon phase, a second liquid foul-water phase, and a second gas comprising hydrogen;

(7) passing said first and second intermediate liquid hydrocarbon phases into a low-pressure separation zone;

(8) withdrawing from said low-pressure separation zone a second liquid hydrocarbon phase, a third liquid foul-water phase, and a gas comprising light hydrocarbons;

(9) separating said second hydrocarbon phase into at least two fractions, including:
  (a) an overhead middle distillate fraction boiling in the range of from about 127° C. (260° F.) to 371° C. (700° F.); and
  (b) a bottoms fraction boiling in the range above about 371° C. (700° F.), said bottoms fraction, at least in part, being used as said bottoms feed; and wherein said catalysts for said zones are selected from the group consisting of catalysts consisting essentially of an amorphous silica-alumina carrier component containing for each part by weight of silica an amount of alumina in the range of from about 0.6 to 4 parts, and at least one hydrogenation component selected from the group consisting of the metals, oxides and sulfides of nickel, cobalt, molybdenum and tungsten, said catalyst containing for each 100 parts by weight an amount, calculated as metal, of said hydrogenation component in the range of from about 1 to 50 parts, said silica and said hydrogenation components, in terms of electron microprobe composition scan of said catalyst, having standard deviations in their respective concentrations around the mean thereof, which is less than about 25 percent.

2. A process as in claim 1 wherein said middle distillate product is separated into 127° C. (260° F.)–260° C. (500° F.) and 260° C. (500° F.)–371° C. (700° F.) cuts.

3. A process as in claim 1 wherein said reaction zones cumulatively process said feed at a fresh feed rate of 1590 KL per day.

4. A process as in claim 1 wherein said catalyst in each reaction zone contains, by weight percent and calculated as the indicated component about as follows:

| | |
|---|---|
| NiO | 10 |
| $WO_3$ | 25 |
| $SiO_2$ | 27 |
| $Al2O_3$ | 30 |
| $TiO_2$ | 8 |

5. A process as in claim 1 wherein at least a major fraction of said heavy distillate feed has a normal boiling point in the range above about 371° C.

6. A process as in claim 1 wherein said nitrogenous content of said first reaction zone effluent is in the range 5 to 30 ppmw.

7. A process as in claim 4 wherein:

(1) said heavy distillate feed is an Arabian medium straight run gas oil having a 371°–565° C. normal boiling range;

(2) said first reaction zone conditions include (i) a hydrogen pressure of about 96.2 atmospheres, (ii) a hydrogen-to-feed ratio of about 114 SCM/KL, (iii) an LHSV of about 1.25 V/V/Hr, and (iv) a temperature in the range 343° C. to 454° C. and sufficient that said first liquid hydrocarbon phase has a nitrogenous hydrocarbon content of about 5 ppmw; and (3) said second reaction zone conditions include (i) a hydrogen partial pressure of about 96 atmospheres, (ii) a hydrogen-to-feed ratio of about 114 SCM/KL, (iii) a liquid hourly space velocity of about 1.33, and (iv) a temperature in the range 343° to 454° C. and sufficient to result in about a 60 volume percent per pass conversion of said bottoms feed to product boiling below 371° C.

8. A process as in claim 1 wherein said catalysts in said reactors are of the same composition and contain titania.

9. A process as in claim 8 wherein said catalysts consist essentially of silica, alumina, and said hydrogenation component.

10. A process for converting a heavy hydrocarbon distillate feedstock boiling above 343° C. and containing more than 100 ppmw organic nitrogen in high yield to a middle distillate product boiling in the range 127°–371° C. which comprises:

(1) hydrocracking and hydrofining said feedstock in a first reaction zone at a hydrocracking conversion of less than 50 volume percent to products boiling below 343° C. and at a hydrofining conversion of said organic nitrogen of at least 50 weight percent, said hydrofining and hydrocracking being conducted in the presence of a catalyst and 2000–70,000 SCF of hydrogen per barrel of said feedstock at conditions including a temperature below 850° F., a hydrogen partial pressure above 1000 psig, and a liquid hourly space velocity of 0.1–5 V/V/hr.;

(2) withdrawing a reaction product effluent from said reaction zone forming a mixture of said effluent with water, removing from said mixture light gases including hydrogen, hydrogen sulfide and light hydrocarbon gases, and further removing from said mixture foul water containing ammonia, to produce a remaining reaction product comprising light hydrocarbons, middle distillate hydrocarbons in substantial quantities and heavier hydrocarbons boiling above 371° C.;

(3) hydrocracking said heavier hydrocarbons in a second reaction zone at a hydrocracking conversion of 40–70 volume percent to products boiling below 371° C., in the presence of a catalyst and 2000–20,000 SCF per barrel of said heavier hydrocarbons at conditions including a temperature below 850° F., a hydrogen partial pressure above 1000 psig, and a liquid hourly space velocity of 1–20 V/V/hr.;

(4) withdrawing a reaction product effluent from said second reaction zone, forming a mixture of said effluent with water, removing from said mixture light gases including hydrogen, hydrogen sulfide and light hydrocarbon gases, and further removing from said mixture foul water containing ammonia, to produce a remaining reaction product comprising light hydrocarbons, and middle distillate hydrocarbons in substantial quantities; said catalysts in each of said first and second reaction zones being selected from the group consisting of catalysts consisting essentially of an amorphous silica-alumina carrier component containing for each part by weight of silica an amount of alumina in the range of from about 0.6 to 4 parts, and at least one hydrogenation component selected from the group consisting of the metals, oxides and sulfides of nickel, cobalt, molybdenum and tungsten, said catalyst containing for each 100 parts by weight an amount, calculated as metal, of said hydrogenation component in the range of from about 1 to 50 parts, said silica and said hydrogenation components, in terms of electron microprobe composition scan of said catalyst, having standard deviations in their respective concentrations around the mean thereof, which is less than about 25 percent.

11. A process as in claim 10 wherein said catalysts are stabilized by a titania component.

12. A process as in claim 11 wherein said catalyst by weight contains an amount of a titanium component, calculated as titanium dioxide in the range of from about 5 to 15 percent.

13. A process as in claim 12 wherein said amount of said titanium component is about 8 percent.

14. A process as in claim 10 wherein said catalyst contains, by weight, calculated as $P_2O_5$, an amount of phosphorus in the range of from about 1 to 5 percent.

* * * * *